US011261824B2

(12) United States Patent
Mastonstråle

(10) Patent No.: US 11,261,824 B2
(45) Date of Patent: Mar. 1, 2022

(54) STIRLING ENGINE COMPRISING METAL FOAM REGENERATOR

(71) Applicant: Maston AB, Älvkarleby (SE)

(72) Inventor: Stefan Mastonstråle, Älvkarleby (SE)

(73) Assignee: Maston AB, Älvkarleby (SE)

( * ) Notice: Subject to any disclaimer, the term of this patent is extended or adjusted under 35 U.S.C. 154(b) by 0 days.

(21) Appl. No.: 16/959,363

(22) PCT Filed: Dec. 20, 2018

(86) PCT No.: PCT/SE2018/051352
§ 371 (c)(1),
(2) Date: Jun. 30, 2020

(87) PCT Pub. No.: WO2019/135695
PCT Pub. Date: Jul. 11, 2019

(65) Prior Publication Data

US 2021/0054808 A1 Feb. 25, 2021

(30) Foreign Application Priority Data

Jan. 2, 2018 (SE) ..... 1850003-3

(51) Int. Cl.
*F02G 1/057* (2006.01)
*F02G 1/043* (2006.01)

(52) U.S. Cl.
CPC ..... *F02G 1/057* (2013.01); *F02G 1/043* (2013.01); *F02G 2257/00* (2013.01)

(58) Field of Classification Search
CPC ..... F02G 1/00–06; F02G 2257/00
See application file for complete search history.

(56) References Cited

U.S. PATENT DOCUMENTS 4,969,333 A 11/1990 Osawa et al.
5,435,140 A 7/1995 Ishino et al.
(Continued)

FOREIGN PATENT DOCUMENTS

EP 1239137 A2 9/2002
EP 2453127 A1 * 5/2012 ..... F02G 1/057
(Continued)

OTHER PUBLICATIONS

International Search Report for the Application No. PCT/SE2018/051352, dated Feb. 15, 2019 in 4 pages.
(Continued)

*Primary Examiner* — Laert Dounis
(74) *Attorney, Agent, or Firm* — Knobbe, Martens, Olson & Bear, LLP

(57) ABSTRACT

A Stirling engine comprising:

a crank case (1) with a crank shaft (2) arranged therein, a displacer cylinder (3) with a reciprocatingly arranged displacer piston (4) therein, said displacer piston (4) being connected to said crank shaft (2) via a connecting rod (5) extending through a first end of said displacer cylinder (3), and wherein the displacer cylinder (3) defines a hot chamber (6) and a cool chamber (7) separated by the displacer piston (4), a working cylinder (8) defining a working cylinder chamber (11) with a reciprocatingly arranged working piston (9) therein, said working piston (9) being connected to said crank shaft (2) via a connecting rod (10) extending through a first end of the working cylinder (8), a heater device (14), arranged at a second end of said displacer cylinder (3) opposite to said first end and configured to heat a working gas which is present in the hot chamber (6) of the displacer cylinder (3) and in fluid communication with the working cylinder chamber (11) through a working gas channel which comprises (Continued)

a first heat exchanger (16) extending from a head (19) of the displacer cylinder (3) into the heater device (14), and a second heat exchanger (17) formed by a regenerator arranged outside the heater device (14). The regenerator (17) comprises a regenerator element (17) formed by metal foam that has an open porosity.

13 Claims, 4 Drawing Sheets

(56) References Cited

U.S. PATENT DOCUMENTS

| | | | | |
|---|---|---|---|---|
| 5,522,722 | A | 6/1996 | Kwon | |
| 2006/0179835 | A1* | 8/2006 | Qiu | F28D 17/02 60/521 |

FOREIGN PATENT DOCUMENTS

| | | | | | |
|---|---|---|---|---|---|
| GB | 2106992 | A | | 4/1983 | |
| JP | 0552661 | U | | 7/1993 | |
| JP | H07293334 | A | * | 11/1995 | |
| JP | 09152211 | A | * | 6/1997 | |
| JP | 09152211 | A | | 6/1997 | |
| WO | H06294349 | A | * | 10/1994 | |
| WO | WO-9519530 | A1 | * | 7/1995 | F25B 9/14 |
| WO | 2010/037358 | A1 | | 8/2010 | |

OTHER PUBLICATIONS

Elizondo, "Production of Optimised Metal Foams for Stirling Engine Regenerators," University of Sheffield; Mar.-May 2011, retrieved at https://www.google.com on Aug. 6, 2018, pp. 20.

Barari, "Metal Foam Regenerators; Heat Transfer and Pressure Drop in Porous Metals," University of Sheffield; Jun. 2014, retrieved at http://etheses.whiterose.ac.uk/6366/1/PhD%20Thesis.pdf on Aug. 6, 2018, pp. 138.

Tanaka et al., "Flow and Heat Transfer Characteristics of the Stirling Engine Regenerator in an Oscillating Flow," JSME International Journal (1990) Series II, vol. 33, No. 2 pp. 283-289.

Indian Examination Report issued for Indian Patent Application No. 202047032564, dated Apr. 16, 2021 in 5 pages.

* cited by examiner

STIRLING ENGINE COMPRISING METAL FOAM REGENERATOR

CROSS-REFERENCE TO RELATED APPLICATIONS

This application is the U.S. National Phase under 35. U.S.C. § 371 of International Application PCT/SE2018/051352, filed Dec. 20, 2018, which claims priority to Swedish Patent Application No. 1850003-3, filed Jan. 2, 2018. The disclosures of the above-described applications are hereby incorporated by reference in their entirety.

TECHNICAL FIELD

The present invention relates to a Stirling engine comprising:

- a crank case with a crank shaft arranged therein,
- a displacer cylinder with a reciprocatingly arranged displacer piston therein, said displacer piston being connected to said crank shaft via a connecting rod extending through a first end of said displacer cylinder, and wherein the displacer cylinder defines a hot chamber and a cool chamber separated by the displacer piston,
- a working cylinder defining a working cylinder chamber with a reciprocatingly arranged working piston therein, said working piston being connected to said crank shaft via a connecting rod extending through a first end of the working cylinder,
- a heater device, arranged at a second end of said displacer cylinder opposite to said first end and configured to heat a working gas which is present in the hot chamber of the displacer cylinder and in fluid communication with the working cylinder chamber through a working gas channel which comprises
- a first heat exchanger extending from a cylinder head of the displacer cylinder into the heater device, and
- a second heat exchanger formed by a regenerator arranged outside the heater device.

A regenerator is referred to as an internal heat exchanger and temporary heat store placed between the hot chamber of the displacer cylinder and the working cylinder such that the working fluid passes through it first in one direction then the other, taking heat from the fluid in one direction, and returning it in the other. It benefits from high surface area, high heat capacity, low conductivity and low flow friction. Its function is to retain within the system the heat that would otherwise be exchanged with the environment at temperatures intermediate to the maximum and minimum cycle temperatures.

BACKGROUND ART

External combustion engines of Stirling type are well known. They may be of three different types, which are named alpha, beta and gamma and differ from each other with regard to how the displacer cylinder, the working cylinder and the displacer piston and the working piston are arranged in relation to each other and to the crank shaft that is driven by the working piston.

Essential to the function of a Stirling engine is that a working medium is heated, preferably by a burner flame in a combustion chamber. During heating thereof, the working gas is conducted through a heat exchanger that may comprise one or more tubes that extend from the hot chamber of the displacer cylinder into the combustion chamber, and further out of the combustion chamber towards a regenerator. The regenerator is located outside the combustion chamber and is the individual component that distinguishes Stirling engines from other types of external combustion engines. After the regenerator, as seen in a flow direction of the working gas from the hot chamber of the displacer cylinder to the working cylinder, there may also be provided a cooler which is configured to cool the working fluid.

The regenerator has as its task to provide for the cooling of the working medium as the latter flows in a first direction from the displacer cylinder to the working cylinder and for the heating of the working medium as is flows in the opposite direction. Accordingly, the regenerator element is assumed to be able of adopting heat from the working gas and transmitting heat to the working gas efficiently with a frequency corresponding to the operating frequency of the engine. The regenerator must be able of standing high temperatures (especially at the hot end thereof closest to the displacer cylinder) and also high pressures. For example the pressure that the regenerator may be subjected to may be in the range of 50 bar, wherein the gas exerting the pressure intermittently comes from the displacer cylinder and from the working cylinder. The regenerator must also not cause excessive pressure drop to the working gas. Accordingly it is a challenge to design a regenerator that fulfils all these requirements.

SUMMARY OF THE INVENTION

It is an object of the present invention to present a Stirling engine that has a regenerator that is capable of performing efficient heat exchange with the working gas and that has a high thermal stability and fatigue strength, is rigid such that it does not get compressed when subjected the pressures that it can be assumed to be subjected to, and that results in a relatively low pressure drop over the regenerator.

The regenerator should also be of a design that promotes non-complicated mounting and exchange thereof.

The object of the invention is achieved by means of the initially defined Stirling engine, which is characterised in that the regenerator comprises a regenerator element formed by metal foam that has an open porosity.

Metal foam has the advantage of being a material that, thanks to its chemical and geometrical constitution, can both be very efficient as heat transceiver and have a very high mechanical strength. The metal may be any metal or metal alloy suitable for use in a high temperature application as a heat exchanging material, such as a ferro chrome alloy or nickel steel. Metal foam can be provided with an open porosity in which the pore size is very small, thereby generating a large effective contact surface for the working gas to exchange heat through. The metal foam may be referred to as open celled metal foam, also called metal sponge. Preferably, the regenerator element has been produced by means of a sintering process in which such porosity is obtainable. A foam of a solid polymer may be used in the process in order to form a skeleton on which the powder mixture to be sintered is adhered before sintering takes place. The provision of an open porosity will provide for a very efficient heat exchange as well as advantageous flow conditions for the working gas.

According to one aspect, the hydraulic porosity is at least 10% of the total volume of the metal foam. Hydraulic porosity is referred to as the porosity available for a working fluid, in this case a working gas, to flow through on its way through the regenerator element. There may also be a closed porosity within the metal foam which is not available for such flow, and which is therefore not part of the hydraulic porosity. A too low hydraulic porosity results in too low heat exchange, and disadvantageous flow conditions. A too high hydraulic porosity may result in a material with too low mechanical strength.

According to one aspect, the hydraulic porosity is within the range of 70-95% of the total volume of the metal foam.

According to one aspect, the metal foam is comprised by a matrix, wherein the matrix material in itself is at least partly hollow. Thereby, there is a closed porosity in the metal foam, wherein the pores of the closed porosity are found inside the matrix material. Such porosity improves the heat exchanging capacity of the metal foam in the sense that rapid exchange of heat can be achieved without the matrix adopting too much heat. According to one aspect, the matrix is formed by interconnected threads of metal that have an average thickness in the region of 10-100 μm, 20-40 μm or 20-25 μm. At least some of the threads are hollow, i.e. have a closed porosity, which results in the above-mentioned closed porosity of the matrix. The hollowness may for example be achieved by means of a production process in which foam of a polymer, having the geometry of the metal foam to be formed, is formed in a mould in a first stage. Thereafter, the open porosity is filled with a suitable material such as plaster. Thereafter, molten metal is introduced into the body, thereby melting down the polymer matrix and taking the place of the latter. The plaster is removed, leaving a remaining open porosity in the formed body. By controlling process parameters such as choice of polymer, choice of metal, metal filling rate, cooling rate etc., the solidification of the metal and the replacement of polymer with metal can be controlled such that the requested degree of hollowness is achieved.

According to one aspect, the porosity inside the matrix material is 1-50% of the total volume of the matrix. If said porosity inside the matrix material is too low, heat exchange capacity will suffer. If said porosity inside the matrix material is too high, mechanical strength and heat absorption capacity suffers.

According to one aspect, the porosity inside the matrix material is 25-50% of the total volume of the matrix.

According to one aspect, the regenerator element comprises at least two sub elements arranged in alignment with each other and one after the other as seen in a longitudinal direction of the working gas flow channel. It can be assumed that the sub element closest to the first heat exchanger, i.e. the hot side of the Stirling engine, is subjected to more severe conditions since it is subjected to larger heat fluctuations and also to higher maximum temperatures than the or those sub elements that are located more remote from the hot side. In case of deterioration of the functionality of any of the sub elements, predominantly the one closest to the hot side, only the functionally deteriorated sub element thus needs to be substituted. The individual sub elements may also be tailor-made with respect to the assumed operational conditions of each sub element. Accordingly, the present invention may include the provision of one or more sub elements that are located closer to the first heat exchanger than one or more other sub elements and that has/have a higher thermal resistance than the sub element or elements that is/are more remote from the first heat exchanger. According to certain feasible aspects, sub elements located closer to the hot side, i.e. towards the displacer cylinder, are formed by a metal having higher thermal stability (including creep and fatigue resistance at elevated temperatures) than sub elements located more remote from the hot side.

According to one aspect, the regenerator element has lower hydraulic porosity in an end thereof turned towards the displacer cylinder than in an end thereof turned towards the working cylinder. Thereby, the part of the regenerator element that is subjected to higher temperature is mechanically stronger the parts thereof that will be subjected to less severe combinations of gas pressure changes and high temperature.

According to one aspect, the regenerator element has lower matrix porosity in an end thereof turned towards the displacer cylinder than in an end thereof turned towards the working cylinder. Thereby, the regenerator element has an increased heat absorption capacity in the region where the largest heat fluctuations and temperatures will occur.

According to one aspect, the regenerator element has an annular cross-section, and is arranged outside and surrounding an outer periphery of the displacer cylinder. The regenerator element is not necessarily in direct contact with an outer periphery of the displacer cylinder. There may be further components, such as a further ring or cylinder, arranged between the regenerator element and the displacer cylinder.

According to one aspect, the regenerator element is clamped between an inner cylinder and an outer cylinder.

Additional objectives, advantages and novel features of the invention will be apparent to one skilled in the art from the following details, and through exercising the invention. While the invention is described below, it should be apparent that the invention may not be limited to the specifically described details. One skilled in the art, having access to the teachings herein, will recognize additional applications, modifications and incorporations in other areas, which are within the scope of the invention.

BRIEF DESCRIPTION OF THE DRAWINGS

For fuller understanding of the present disclosure and further objects and advantages of it, the detailed description set out below should be read together with the accompanying drawings, in which the same reference notations denote similar items in the various diagrams, and in which.

DETAILED DESCRIPTION

Figure 1:
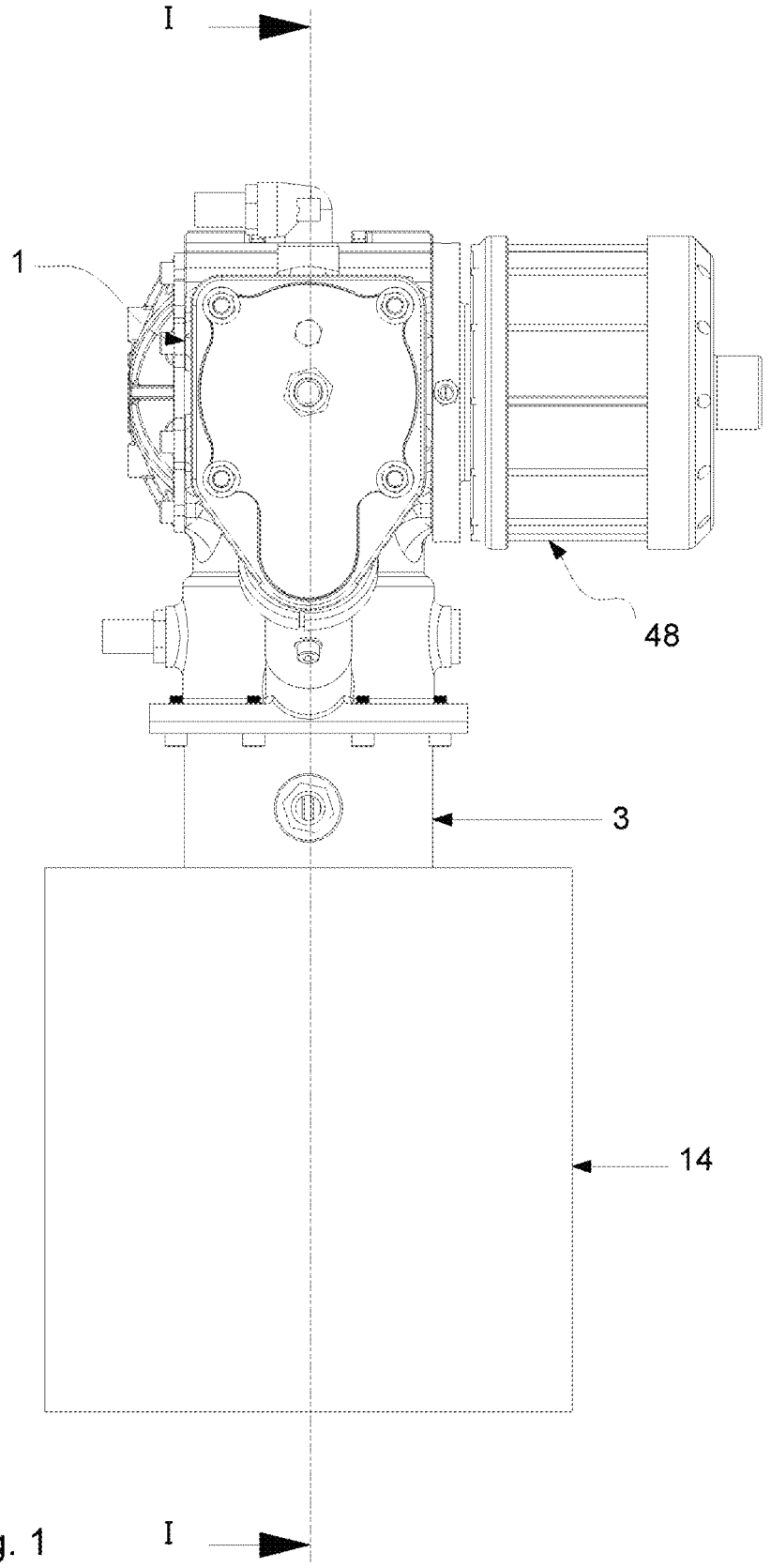
FIG. 1 is a view from above of a Stirling engine according to an example provided with a schematically shown heater device.
Figure 2:
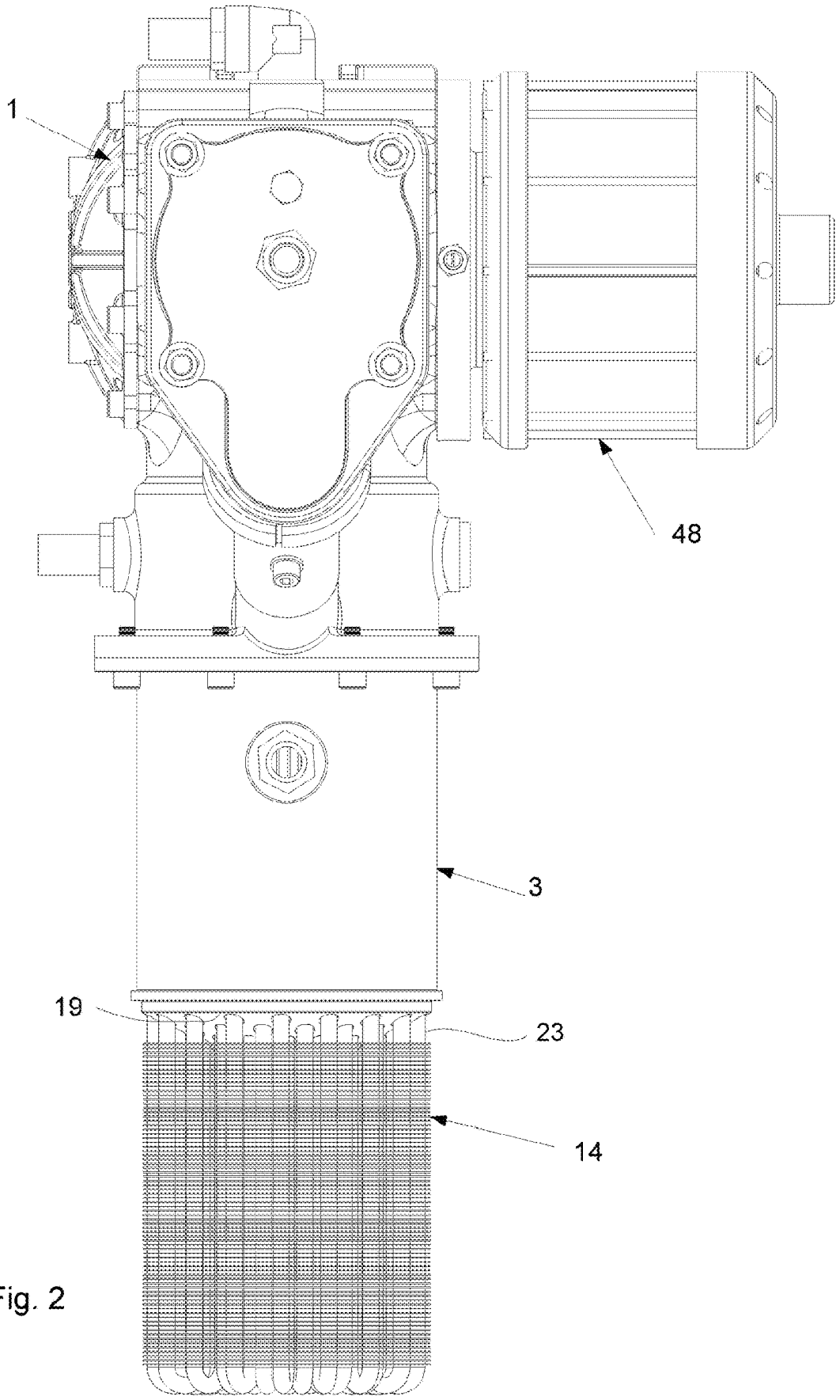
FIG. 2 is a view corresponding to FIG. 1, but with the heater device removed from the rest of the engine.
Figure 3:
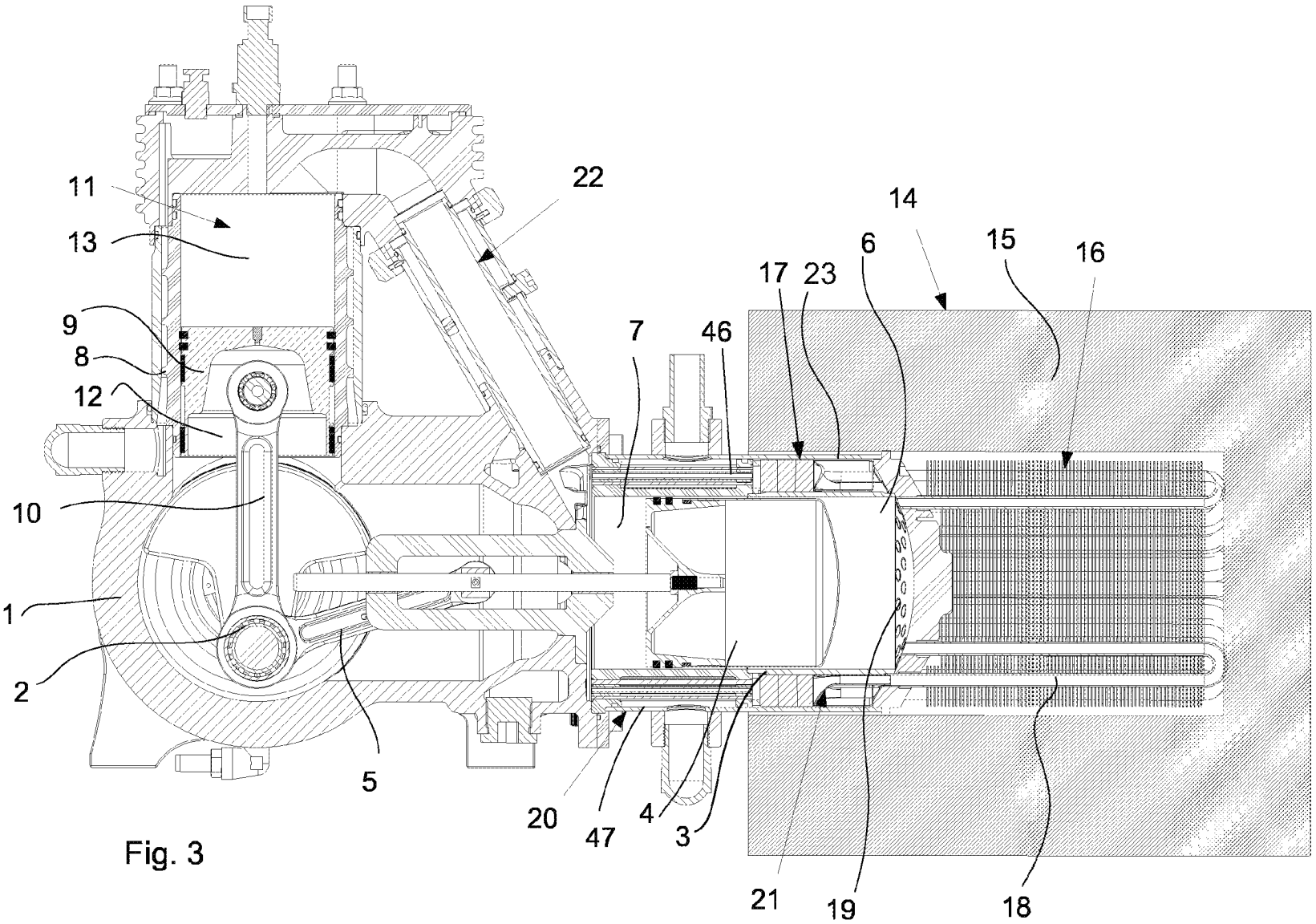
FIG. 3 is a cross-section according to in FIG. 1, still with the heater device shown schematically.
Figure 4:
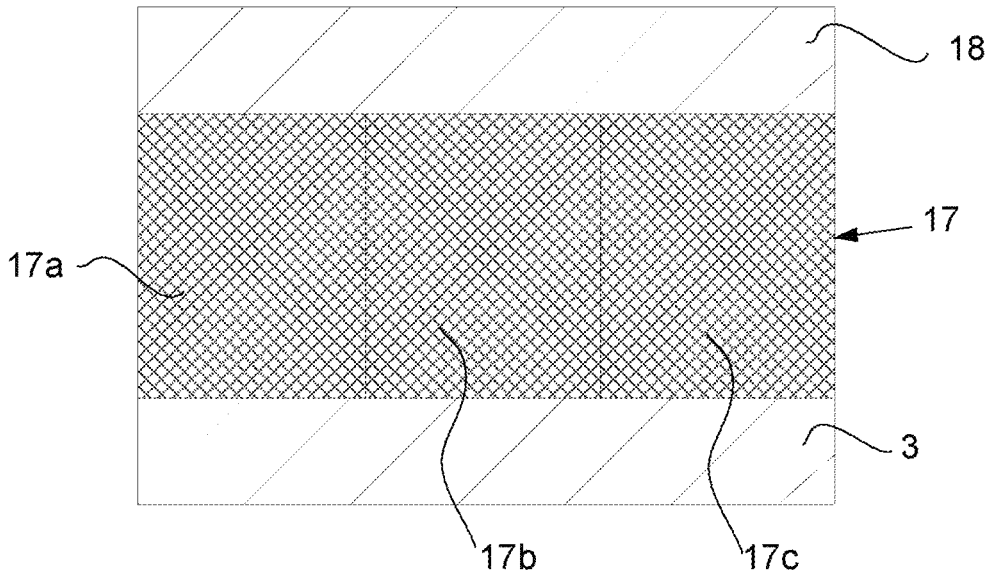
FIG. 4 is a cross-section of a part of the regenerator element.
Figure 5:
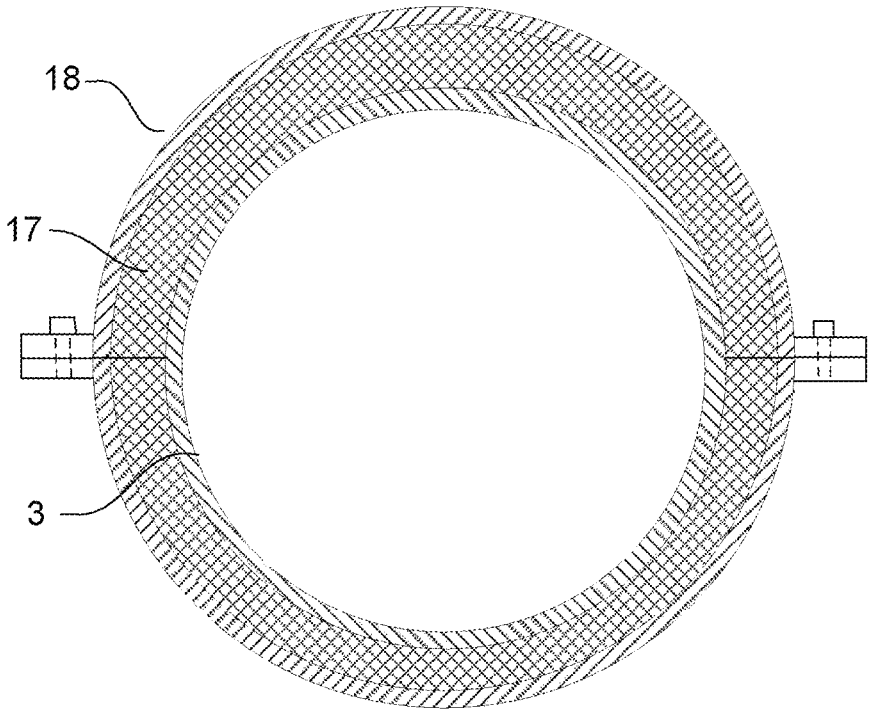
FIG. 5 is an end view showing the regenerator element as clamped between an inner and an outer cylinder.

FIGS. 1-3 show an example of a Stirling engine according to the present disclosure. The Stirling engine shown is of gamma type and comprises a crank case 1 with a crank shaft 2 arranged therein, and a displacer cylinder 3 with a reciprocatingly arranged displacer piston 4 therein. The displacer piston 4 is connected to the crank shaft 2 via a connecting rod 5 extending through a first end of said displacer cylinder 3. During operation of the Stirling engine, the displacer cylinder 3 defines a hot chamber 6 and a cool chamber 7 separated by the displacer piston 4.

The Stirling engine further comprises a working cylinder 8 with a reciprocatingly arranged working piston 9 therein, said working piston 9 being connected to the crank shaft 2 via a connecting rod 10 extending through a first end of the working cylinder 8. A working cylinder chamber 11 defined by the working cylinder 8 is divided by the working piston 9 into a first part 12, through which said connecting rod 10 extends, and a second part 13 configured to house a working gas during operation of the Stirling engine. The second part 13 of the working cylinder chamber 11 is in fluid communication with the hot chamber 6 of the displacer cylinder 3 for the transportation of the working gas between said second part 13 of the working chamber 11 and the hot chamber 6 of the displacer cylinder 3 during operation of the engine.

A heater device 14 is arranged at a second end of the displacer cylinder opposite to said first end and configured to heat a working gas which is present in the hot chamber 6 of the displacer cylinder 3 and which is in fluid communication with the second part 13 of the working cylinder chamber 11. In the example shown the heater device 14 comprises a combustion chamber 15 which is arranged at the second end of said displacer cylinder 3 opposite to said first end.

Furthermore, the Stirling engine comprises a first heat exchanger 16 and a second heat exchanger 17. The first heat exchanger 16 comprises plurality of tubes 23 that extend from a displacer cylinder head 19 provided at said second end of the displacer cylinder 3 into the combustion chamber 15 and out of the combustion chamber 15 to the second heat exchanger 17. The second heat exchanger 17 is comprised by a regenerator provided outside the combustion chamber 15 and outside the displacer cylinder 3. In the example shown the engine also comprises a third heat exchanger 20 formed by a cooler arranged between the regenerator 17 and the working cylinder chamber 11, a first transition flow element 21 provided between said first and second heat exchangers 16, 17, and a second transition flow element 22 provided between the third heat exchanger 20 and the working cylinder 8. The cooler 20 comprises a body with channels 46 for the conduction of the working gas therethrough and with further channels 47 which form part of a cooling medium circuit.

The hot chamber 6 defined by the displacer cylinder 3 is in fluid communication with a second end, i.e. the above-defined second part 13, of the working cylinder chamber 11 through a channel comprising the first heat exchanger 16, the second heat exchanger 17, the third heat exchanger 20, the first transition flow element 21 and the second transition flow element 22.

The regenerator 17 comprises a regenerator element formed by metal foam that has an open porosity, thereby enabling the working gas to flow through the regenerator element while at the same time exchanging heat therewith. The hydraulic porosity of the regenerator element, referred to as the porosity available for a working fluid, in this case a working gas, to flow through on its way through the regenerator element, is within the range of 70-95% of the total volume of the metal foam. The metal may be any metal or metal alloy suitable for use in a high temperature application, such as a ferro chrome alloy or a nickel steel alloy.

The metal foam of the regenerator 17 is comprised by a matrix, wherein the matrix material in itself is at least partly hollow. The porosity inside the matrix material is 25-50% of the total volume of the matrix and forms part of a closed porosity in the metal foam, excluded from what is defined as hydraulic porosity hereinabove.

The regenerator element 17 comprises a plurality of sub elements 17*a*, 17*b*, 17*c*, arranged in alignment with each other and one after the other as seen in a longitudinal direction of the working gas flow channel. The regenerator element has lower hydraulic porosity in an end thereof turned towards the displacer cylinder 3 than in an end thereof turned towards the working cylinder 8. This is accomplished as the sub element 17*a* most adjacent the displacer cylinder 3 has lower hydraulic porosity than the sub element 17*c* most adjacent the working cylinder 8.

The regenerator element 17 has lower matrix porosity in an end thereof turned towards the displacer cylinder 3 than in an end thereof turned towards the working cylinder 8. This is accomplished as the sub element 17*a* most adjacent the displacer cylinder 3 has lower matrix porosity than the sub element 17*c* most adjacent the working cylinder 8.

The regenerator element 17 has an annular cross-section and is arranged outside and surrounding an outer periphery of the displacer cylinder 3. Each sub element 17, 17*b*, 17*c* has an annular shape and is subdivided in two halves, thereby enabling easy assembly thereof onto the outer periphery of displacer cylinder 3. An outer cylinder 18 formed by an annular element subdivided in two halves is arranged on the outer periphery of the regenerator element 17 and clamps the latter against the displacer cylinder 3.

The foregoing description of the examples has been furnished for illustrative and descriptive purposes. It is not intended to be exhaustive, or to limit the examples to the variants described. Many modifications and variations will obviously be apparent to one skilled in the art. The examples have been chosen and described in order to best explicate principles and practical applications, and to thereby enable one skilled in the art to understand the examples in terms of its various examples and with the various modifications that are applicable to its intended use. The components and features specified above may, within the framework of the examples, be combined between different examples specified.

What is claimed is:

1. A stirling engine comprising:

a crank case with a crank shaft arranged therein, a displacer cylinder with a reciprocatingly arranged displacer piston therein, said displacer piston being connected to said crank shaft via a connecting rod extending through a first end of said displacer cylinder, and wherein the displacer cylinder defines a hot chamber and a cool chamber separated by the displacer piston, a working cylinder defining a working cylinder chamber with a reciprocatingly arranged working piston therein, said working piston being connected to said crank shaft via a connecting rod extending through a first end of the working cylinder, a heater device, arranged at a second end of said displacer cylinder opposite to said first end and configured to heat a working gas which is present in the hot chamber of the displacer cylinder and in fluid communication with the working cylinder chamber through a working gas channel which comprises a first heat exchanger extending from a head of the displacer cylinder into the heater device, and a second heat exchanger formed by a regenerator arranged outside the heater device, wherein the regenerator comprises a regenerator formed by metal foam that has an open porosity, wherein the metal foam is comprised by a matrix, and wherein the matrix material in itself is at least partly hollow.

2. The stirling engine according to claim 1, wherein hydraulic porosity of the regenerator is at least 10% of the total volume of the metal foam.

3. The stirling engine according to claim 2, wherein the hydraulic porosity is within the range of 70-95% of the total volume of the metal foam.

4. The stirling engine according to claim 1, wherein the porosity inside the matrix material is 1-50% of the total volume of the matrix.

5. The stirling engine according to claim 1, wherein the porosity inside the matrix material is 25-50% of the total volume of the matrix.

6. The stirling engine according to claim 1, wherein the regenerator comprises at least two sub elements arranged in alignment with each other and one after the other as seen in a longitudinal direction of the working gas flow channel.

7. The stirling engine according to claim 6, wherein the regenerator has lower hydraulic porosity in an end thereof turned towards the displacer cylinder than in an end thereof turned towards the working cylinder.

8. The stirling engine according to claim 1, wherein the regenerator has lower matrix porosity in an end thereof turned towards the displacer cylinder than in an end thereof turned towards the working cylinder.

9. The stirling engine according to claim 1, wherein the regenerator has an annular cross-section and it is arranged outside and surrounding an outer periphery of the displacer cylinder.

10. The stirling engine according to claim 1, wherein the regenerator is clamped between an inner cylinder and an outer cylinder.

11. The stirling engine according to claim 10, wherein said inner cylinder is the displacer cylinder.

12. The stirling engine according to claim 6, wherein the regenerator has lower matrix porosity in an end thereof turned towards the displacer cylinder than in an end thereof turned towards the working cylinder.

13. The stirling engine according to claim 7, wherein the regenerator has lower matrix porosity in an end thereof turned towards the displacer cylinder than in an end thereof turned towards the working cylinder.

* * * * *